United States Patent [19]

Grassle et al.

[11] 4,148,282

[45] Apr. 10, 1979

[54] METHOD AND APPARATUS FOR COLD STARTING FUEL INJECTED INTERNAL COMBUSTION ENGINES

[75] Inventors: Alfred Grassle, Ludwigsburg; Hans Schnürle, Walheim; Thomas Wilfert, Markgroningen, all of Fed. Rep. of Germany

[73] Assignee: Robert Bosch GmbH, Stuttgart, Fed. Rep. of Germany

[21] Appl. No.: 911,591

[22] Filed: Jun. 1, 1978

[63] Continuation of Ser. No. 668, 419, Mar. 19, 1976.

[30] Foreign Application Priority Data

Mar. 19, 1975 [DE] Fed. Rep. of Germany ..... 2511976

[51] Int. Cl.[2] ..... F02B 3/00

[52] U.S. Cl. ..... 123/32 EG; 123/179 G; 123/179 L

[58] Field of Search ..... 123/32 EA, 32 EG, 179 A, 123/179 B, 179 G, 179 L

[56] References Cited

U.S. PATENT DOCUMENTS

| | | | |
|---|---|---|---|
| 3,504,657 | 4/1970 | Eichler et al. | 123/32 EG |
| 3,628,510 | 12/1971 | Moulds et al. | 123/179 L |
| 3,646,917 | 3/1972 | Nagy | 123/32 EG |
| 3,683,871 | 8/1972 | Barr et al. | 123/179 L |
| 3,698,373 | 10/1972 | Nagasawa | 123/179 L |
| 3,734,067 | 5/1973 | Glockler et al. | 123/179 L |
| 3,949,714 | 4/1976 | Mitchell | 123/32 EA |
| 3,991,726 | 11/1976 | Kawai et al. | 123/179 L |

*Primary Examiner*—Charles J. Myhre
*Assistant Examiner*—David D. Reynolds
*Attorney, Agent, or Firm*—Edwin E. Greigg

[57] ABSTRACT

A control circuit for a fuel-injected internal combustion engine provides a substitute program for generation of fuel injection control pulses during engine starts at low temperatures. The substitute injection control pulses are made dependent on the ambient or engine temperature in the sense that, the lower the temperature, the greater is the length of the injection pulses, i.e., the larger is the quantity of initially injected fuel. The length of the injection pulses also depends on the elapsed duration of the engine starting attempt in the sense of gradually reducing the injected fuel quantity as the unsuccessful engine cranking proceeds. A fully opened throttle during engine cranking signals a flooded engine condition and completely interrupts fuel injection.

22 Claims, 4 Drawing Figures

METHOD AND APPARATUS FOR COLD STARTING FUEL INJECTED INTERNAL COMBUSTION ENGINES

This is a continuation of application Ser. No. 668,419 filed Mar. 19, 1976.

BACKGROUND OF THE INVENTION

The invention relates to a method and apparatus for the cold starting control of fuel injection systems, especially when used at very low temperatures.

In known fuel injection systems for internal combustion engines, a supplementary quantity of fuel is introduced during the starting and prior to and during the engine motion due to combustion. Such a supplementary fuel quantity is required because, in a cold engine, a large portion of the introduced fuel condenses on the walls of cold induction tubes, cylinders and pistons and thus prevents the formation of a combustible fuel-air mixture. The lower the engine temperature is during start-up, the more pronounced this problem becomes.

For this reason, a known fuel injection system includes a separate cold-start valve, located in the induction tube, which acts in addition to the normally present fuel injections valves. During starting temperatures below 20° C., the cold starting valve supplies additional fuel to the engine and its operation is controlled by a thermal switch.

It is also conceivable to provide a fuel injection system which includes additional sensors for various engine variables and to transmit these signals from the sensors to various portions of the control circuit of the fuel injection system so as to permit a cold starting injection program. However, the engine conditions during cold starting are very complicated and make such a procedure unsuitable. Furthermore, a successful cold starting is not possible at very low temperatures.

OBJECT AND SUMMARY OF THE INVENTION

It is a principal object of the invention to provide a process and apparatus for cold starting in an internal combustion engine which employs already present fuel injection valves and other elements which are so embodied that a supplementary cold starting valve can be dispensed with. It is a further object of the invention to provide a method and and apparatus which permits satisfactory starting of the internal combustion engines at temperatures as low as −30° C. and even lower.

These objects are attained, according to the invention, by proceeding from the above-described method and adding the improvement that, during the engine start-up, the normal fuel injection control program is disabled and the already present fuel injection valves are controlled by a separate control circuit. The separate control circuit provides injection information which depends on the duration of the starting process and reduces the supplied fuel quantity according to a predetermined program depending on the duration of the starting process. The initially injected quantity may be adjusted to the particular vehicle type, as well as to the ambient temperature.

The method according to the invention brings the advantage that two normally required elements, namely the cold starting valve and an associated thermal time switch, may be dispensed with, thus substantially reducing the construction expense. Furthermore, the starting times are reduced during low ambient temperature conditions, thus saving the battery and assuring a reliable start.

An apparatus for carrying out the process according to this invention includes a circuit in which a monostable multivibrator provides injection control pulses to, preferably, the final stage of an already present fuel injection system. The switching time of this multivibrator is determined by the discharge time of a capacitor which is controlled by an associated discharge control circuit. The duration of the starting process and the initial ambient and engine temperature are control parameters in the apparatus according to the invention.

The invention will be better understood as well as further objects and advantages thereof become more apparent from the ensuing detailed specification of a preferred embodiment taken in conjunction with the drawing.

DESCRIPTION OF THE PREFERRED EMBODIMENT

The general layout and the function of the invention will now be explained with the aid of the block diagram of FIG. 1.

Figure 4:
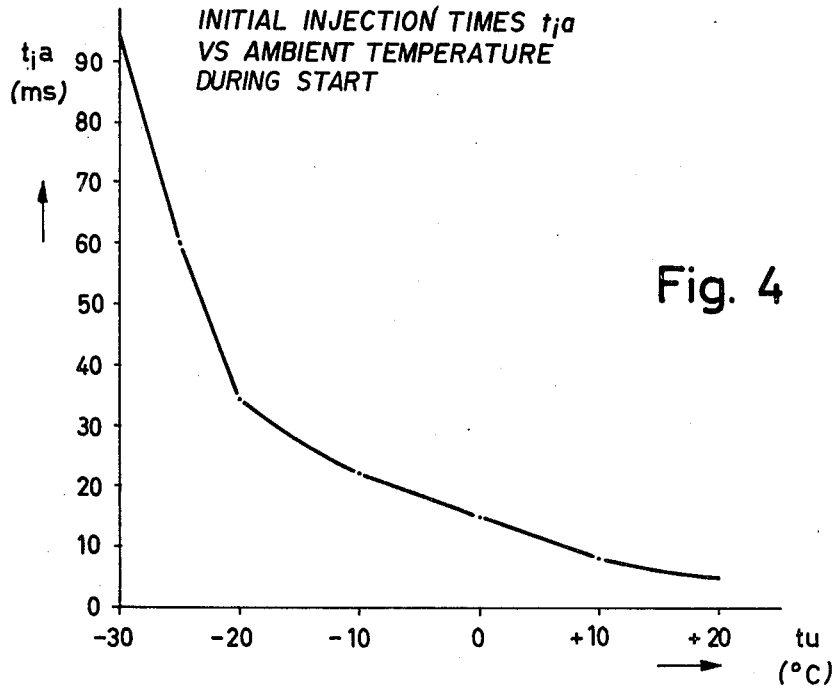
FIG. 4 is a diagram showing the initial injection pulse period as a function of the ambient temperature.

As has already been mentioned, the fuel quantity to be supplied to the engine during the start-up must not only be dependent on ambient temperature, i.e., in a manner, shown in FIG. 4, wherein the duration of the injection pulses or the injected fuel quantity at the beginning of the starting process depend on the ambient temperature, but, in addition, the fuel quantity must also vary depending on the duration of the on-going starting process. This latter change must be such that the fuel quantity is reduced as the starting process proceeds.

It will be useful to summarize the conditions which the circuit according to the invention will be required to fulfill, including the indispensable requirements already recited:

1. The fuel quantity injected by the normally present injection valves of the engine during the starting process has an initial value which depends on the prevailing ambient temperature which is generally the same as the coolant temperature of the engine;
2. The fuel quantity supplied to the engine must change during the starting process in rpm-dependent manner, i.e., the fuel quantity must be reduced while the electric starter attempts to start the engine;
3. During the engine starting process, the normal fuel injection control pulses must be turned off;
4. If a second and repeated starting process takes place, for example because the operator of the vehicle has abandoned his earlier starting attempt, the circuit should provide a fuel quantity which is less than that originally supplied because, otherwise, the mixture would become too rich;
5. Since a cold starting process requires substantial quantities of fuel, this fuel must be distributed over a larger time period during the crankshaft rotation which may be achieved by providing a double injection, i.e., the control circuit provides two injection pulses for each crankshaft revolution; and 6. If for any reason the engine becomes flooded, then, during any renewed starting attempt which takes place with fully opened throttle for the purpose of drying out the combustion chambers, no fuel is injected at all.

The circuit to be described in detail below fulfills all of the above requirements and, furthermore, has the inherent advantage that it may be associated with a normal and customary fuel injection system without substantial expense.

Figure 1:
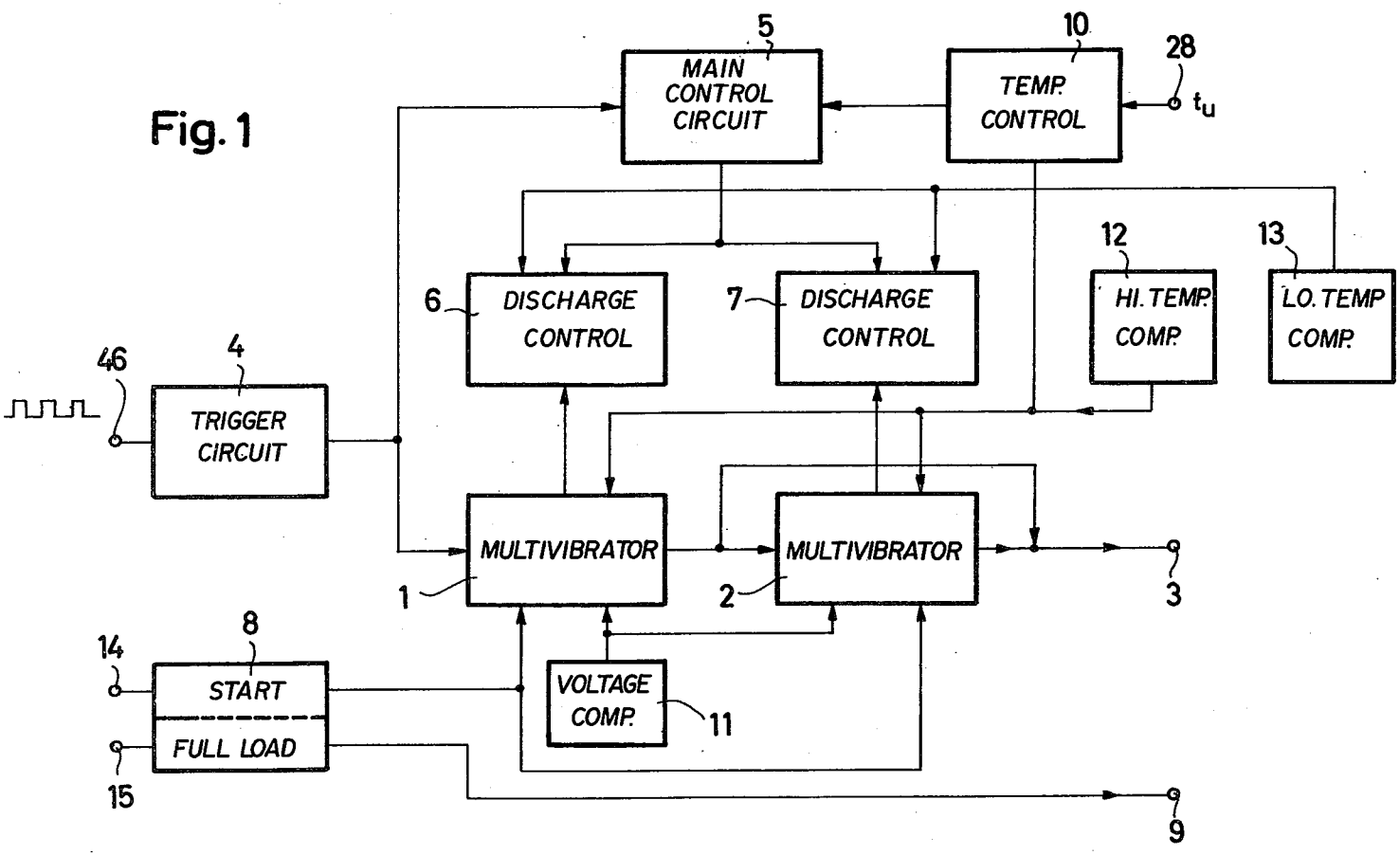
FIG. 1 is a schematic block diagram of an apparatus according to the invention.

Turning now to FIG. 1, there may be seen a monostable multivibrator 1 whose unstable time constant provides the duration of the fuel injection pulse during the start-up. Preferably, a second monostable multivibrator 2 is connected behind the first monostable multivibrator and its output delivers a supplementary injection pulse during the unstable period and this second pulse is added to that of the first monostable multivibrator 1. Thus, the output contact 3 in FIG. 1 delivers two injection pulses for each revolution of the crankshaft; their duration determines the fuel quantity provided to the engine during start-up. The control pulses from the contact 3 can directly control customary injection valves in the induction manifold or in the cylinder heads of the internal combustion engine. However, the control pulses from contact 3 may also be fed to the final control circuit of an already present fuel injection system.

The multivibrators 1 and 2 are triggered by a triggering circuit 4 which is itself triggered by rpm-synchronous pulses derived, for example, from the ignition pulses of the engine, preferably after passing through a pulse shaping circuit. The output from the triggering circuit is connected firstly to the trigger input of the multivibrator 1 (which in turn triggers the multivibrator 2) and at the same time is connected to an rpm-dependent control circuit 5 which, in turn, controls discharge circuits 6 and 7 which define the unstable time constant of the multivibrators 1 and 2, respectively, and hence define the duration of the fuel injection pulses.

The circuit further includes a starting control block 8 whose contact 9 provides a signal that turns off the normal injection pulses from the fuel injection system and may provide the power for the multivibrators 1 and 2 and which also prevents triggering of the multivibrators 1 and 2 if the gas pedal of the engine is completely depressed during the starting, i.e., when the operator attempts to dry out a flooded engine so that the starting control circuit 8 receives a full-load signal.

A temperature compensation circuit 10 feeds to the control circuit 5 a signal used in setting the length of the injection pulses and this same information is also supplied to the multivibrators 1 and 2.

Finally, the circuit includes elements 11, 12, and 13, all of which affect the unstable time constant of the multivibrators 1 and 2. The circuit 11 provides voltage compensation and the circuits 12 and 13 provide compensation for high or low temperatures, respectively.

The starting control circuit 8 receives input data concerning the actuation of the starter on a contact 14, while the contact 15 receives a full-load signal, for example, a positive voltage from an appropriate throttle valve transducer. The temperature compensating circuit 10 is, preferably, a temperature-dependent resistor with a negative temperature coefficient.

Figure 2:
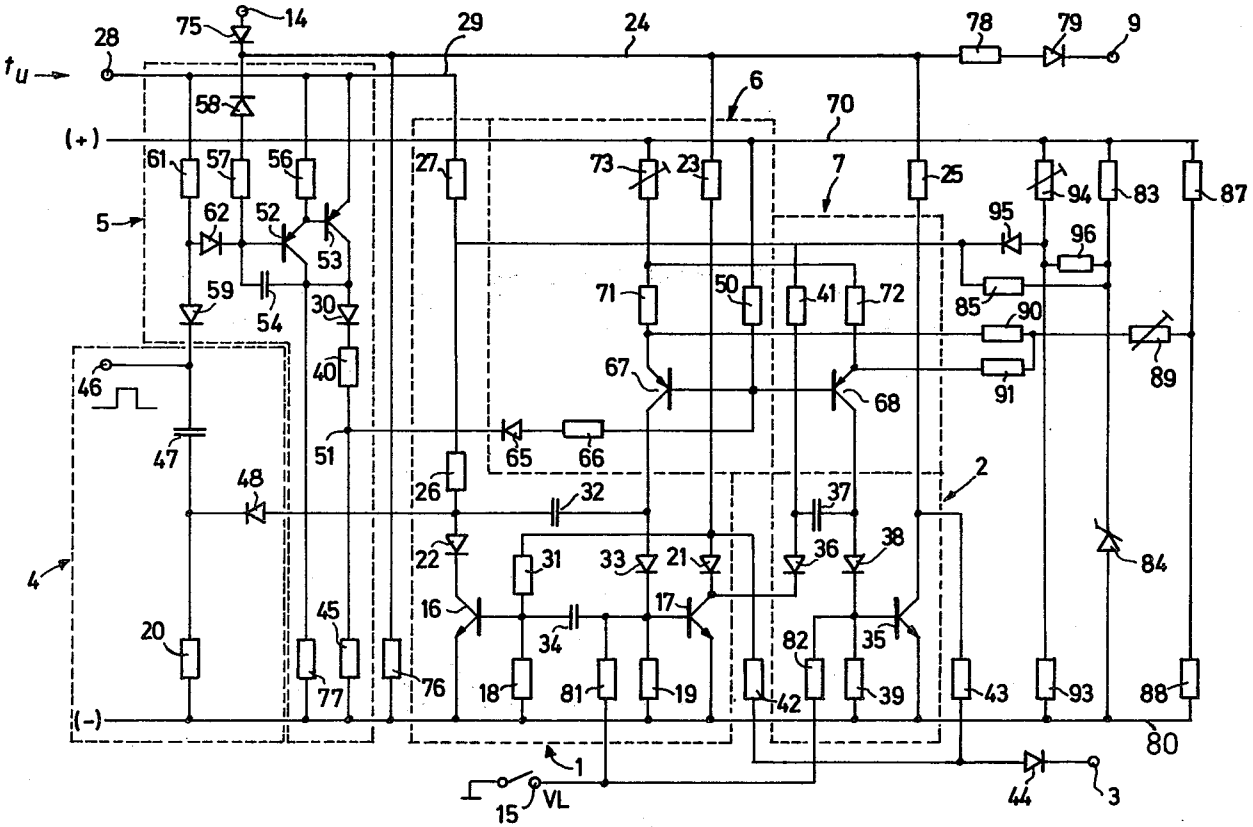
FIG. 2 is a detailed circuit diagram of the circuit blocks shown in FIG. 1.

Turning now to FIG. 2, there is shown the detailed circuit diagram of the various components of the system depicted in FIG. 1, and the circuit blocks of FIG. 1 are indicated in FIG. 2 by dashed-line peripheries having the same reference numerals.

The circuit shown in FIG. 2 will now be described in general terms. The monostable multivibrator 1 is formed from two transistors 16 and 17 whose emitters are coupled directly to ground or to the negative source of potential applied to the bus 80. The bases of the two transistors are connected via resistors 18 and 19, respectively, to ground while their collectors are connected through diodes 21 and 22 to respective conductors at positive potential. The collector of transistor 17 is connected through a resistor 23 with a conductor 24 which carries positive potential when the engine starter is in operation. The collector of transistor 16 is connected through resistors 26 and 27 to a conductor 29 which is connected to an input contact 28 provided with a temperature-dependent positive potential. In the present exemplary embodiment, the input contact 28 is the same point as the output of the temperature compensating circuit 10 in the block diagram of FIG. 1. This point is preferably connected to a temperature-dependent resistor located within the coolant of the engine in such a manner that the contact 28 carries a positive potential controlled by the ambient temperature $T_u$ in an inverse temperature dependence, i.e., the voltage decreases for increasing temperature (increasing ambient heat).

The base of transistor 16 is connected through a resistor 31 with the collector of transistor 17 in the usual manner; the resistor 31 is connected behind the diode 21. Behind the diode 22, the collector of transistor 16 is connected, via a capacitor 32, with the anode of a diode 33 whose cathode is connected to the base of transistor 17. The bases of the transistors 16 and 17 are coupled through a further capacitor 34.

Connected to the first multivibrator 1 is a second multivibrator, embodied as a single transistor 35, whose base is directly controlled by the collector of transistor 17 via a diode 36, a capacitor 37 and a further diode 38. The base of the transistor 35 is also connected to ground or to the negative bus 80 via a resistor 39. It is to be understood that the particular polarity designations of the diodes and the choice of the transistors are merely exemplary and are not to be regarded as limiting the invention to these choices. The switching characteristics of the two multivibrators 1 and 2 (multivibrator 2 being provided only for the production of a supplementary injection pulse and for the extension of the duration of the pulse in a precise manner) are determined by the two capacitors 32 and 37, whose electrodes remote from the bases of transistors 17 and 35 are connected through a resistor 41 and resistors 26 and 27, respectively, with the temperature dependently supplied conductor 29. Since their opposite electrodes are connected to ground via diodes 33 and 38, respectively, and resistors 19 and 39, respectively, these capacitors are charged up to a potential which is proportional to the temperature $T_u$ whenever the circuit of FIG. 2 is energized.

Whenever the transistor 17 within the multivibrator 1 and the single transistor 35 of multivibrator 2 conduct, their collectors are substantially at ground potential and the multivibrators are in their stable state. These collectors are combined via resistors 42 and 43, respectively, in a common junction which is connected through a diode 44 to contact 3 of FIG. 1, described above. Thus, the contact 3 carries the injection start pulses of the control circuit in FIG. 2 as positive potentials of predetermined duration and whenever the transistor 17 and, subsequently, the transistor 35, are blocked during the unstable time period of the respective multivibrators 1 and 2.

The multivibrator 1 is triggered by the triggering circuit 4 which receives an rpm-dependent trigger signal. This trigger signal is differentiated by a capacitor 47 and a grounded resistor 20, resulting in a negative spike which is passed by the diode 48 to the junction of the diode 22 and the capacitor 32. When the spike reaches the base of transistor 17, it triggers the multivibrator 1 into its unstable state by blocking the transistor 17 so that the output contact 3 carries a first positive injection starting pulse.

The duration of the unstable state of the multivibrator 1 is defined by the discharge time or recharge time of the capacitor 32 whose electrode remote from the base of transistor 17 is conducted to ground via the conducting transistor 16. The circuit is so designed that the capacitor 32 can discharge only through the discharge circuit 6 which will be explained in more detail below. In other words, the unstable time constant of the multivibrator 1 is determined, firstly, by the magnitude of the positive potential on the conductor 29 as determined by the temperature and, secondly, by the discharge process via the circuit 6. To aid in the understanding of the circuit it will now be useful to consider the construction and operation of the control circuit 5 whose contact 51 provides a voltage which depends on ambient temperature as well as on the duration of the starting process.

The control circuit 5 includes two transistors 52 and 53 connected in Darlington configuration, including a capacitor 54 between the base and emitter of the transistor 52. The charge on the capacitor 54 is a measure of the voltage at the output contact 51 of the control circuit 5. The emitter of the transistor 53 is connected directly to the conductor 29, while the emitter of the transistor 52 is connected to the conductor 29 through a resistor 56. Both emitters are thus connected to a conductor carrying a temperature-dependent positive input signal. The base of the transistor 52 is connected through a resistor 57 and a diode 58 to the conductor 24 which carries a positive potential during the engine starting process, the diode 58 being polarized so as to block this potential. From the contact 46, trigger pulses flow through a diode 59, which blocks positive potential, to the control circuit 5. The anode of the diode 59 is connected through a resistor 61 to the conductor 29, and the junction of the resistor 61 and the diode 59 is connected via a negative blocking diode 62 to the base of the first Darlington transistor 52.

Accordingly, the control circuit 5 operates in such a manner that, when a positive trigger pulse is present at the contact 46, the diode 59 is blocked, so that the current path defined by the resistor 61, the diode 59, the capacitor 47 and the resistor 20 is interrupted to ground. As a result, the voltage at the anode of the diode 62 becomes sharply positive and reaches the capacitor 54 which is incrementally charged further during each positive trigger pulse. The small base current of the transistor 52 also adds to the current to diode 62. Thus, a positive charging current for the capacitor 54 flows only during the duration of occurrence of the trigger pulses and, since the diodes 62 and 58 prevent discharging during the engine starting, the capacitor 54 attains increasing positive potentials with respect to the base of transistor 52. As has already been mentioned, the multivibrator 1 is triggered by the negative trailing edge of the trigger, i.e., the multivibrator 1 is triggered at a time when the diode is switched into conduction by the occurrence of a negative potential at its cathode so that the diode 62 blocks. At that time, the two Darlington transistors 52 and 53 are controlled exclusively by the potential on the capacitor 54 and that potential remains practically unchanged because of the very small base current of the Darlington circuit. Thus, as the engine starting process progresses, and the Darlington circuit is increasingly blocked, the collector of the transistor 53 receives a temperature-dependent signal from the contact 28 whose potential also changes in dependence on the duration of the starting process and dependent on the number of trigger pulses present at the contact 46. Thus, the potential at the collector of the transistor 53, i.e., at the output 51 of the control circuit 5, continuously changes toward negative values. Thus, the signal occurring at the output contact 51 is, firstly, a temperature-dependently and, secondly, an rpm-dependently controlled signal. It will be recognized that the control circuit 5 represents a so-called Miller integrator.

The signal from the contact 51 flows to the cathode of a diode 65 whose anode is connected in series with a resistor 66. The signal then continues to the bases of transistors 67 and 68 which are substantial constituents of the discharge circuits 6 and 7, respectively.

The collectors of both of these transistors are connected directly to the capacitors 32 and 37, respectively, which define the time constants of the multivibrators 1 and 2, respectively. Accordingly, the capacitors 32 and 37 are permitted to discharge through transistors 67 and 68, respectively, to the positive supply line 70. The emitters of transistors 67 and 68 are joined through respective resistors 71 and 72 and are connected through a further trimmer resistor 73 to the positive supply line 70.

Thus, while the engine starting process continues, the control voltage for the two transistors 67 and 68 in discharge circuits 6 and 7, respectively, is shifted to more negative values and the discharge circuits are made increasingly conducting so that the discharge of the capacitors 32 and 37 proceeds ever more rapidly which, as may be understood from the previous discussion, leads to a shortening in the duration of the injection start pulses which are present at the output contact 3.

It should be noted that a single multivibrator 1 will suffice even if embodied as a single transistor, but the use of two multivibrators results in a more precise determination of the duration of the injection start pulses even when the power supply voltage for the control circuits drops considerably due to very low temperatures.

Figure 3:
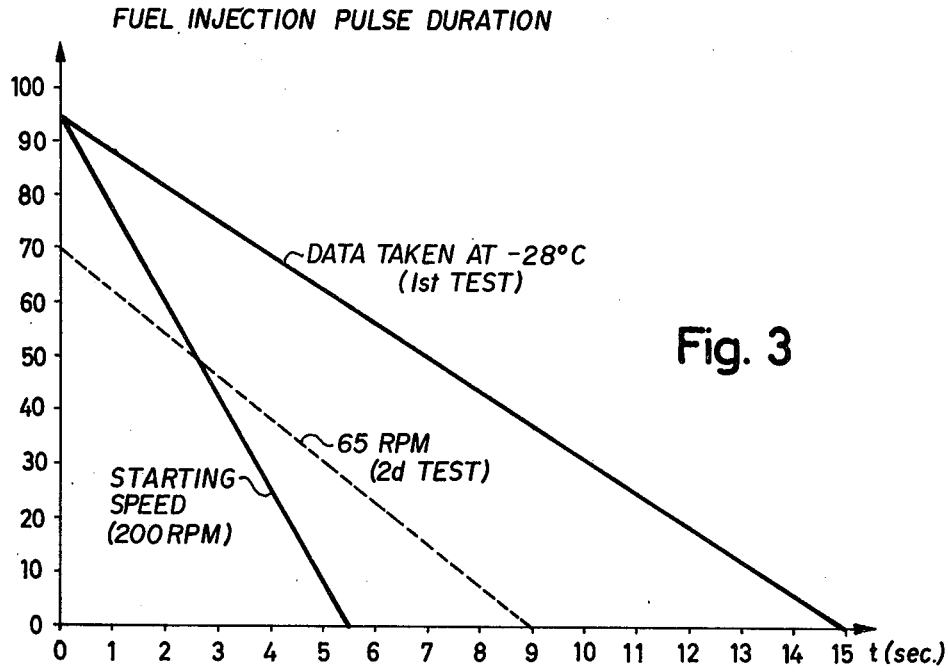
FIG. 3 is a diagram showing the duration of the injection pulses as a function of starting time for two different starting speeds.

Thus, it is possible to adapt the duration of the injection start pulses very precisely to the curve shown in FIG. 3, firstly, by obtaining a general decrease of the duration of the pulses as a function of time and, secondly, by obtaining a substantially steeper decrease for higher cranking speeds, thanks to the Miller integrator in the control circuit 5.

Very often, vehicle operators who attempt to start engines at very low ambient temperatures abandon the starting process after a certain length of time to save the battery even though such an action is not really necessary. In such a case, however, it is desirable that any subsequent attempt at starting the engine would not be made with the same relatively long-lasting injection pulses used previously, because that would very easily lead to a hyperenrichment of the mixture and thus would tend to "flood" the engine. This problem is also solved by the control circuit according to the present invention. As may be seen, during the starting process, the capacitor 54 does not discharge at all, because the cathode of the diode 58 receives the positive potential of the starter, present at contact 14, via a diode 75. However, when the starting process is interrupted, the potential on conductor 24 vanishes and the capacitor 54 discharges through the resistor 57, the diode 58, a resistor 76 and a resistor 77 to ground. The discharge proceeds at an appropriately chosen rate so that, if the engine starting attempt is repeated after a certain amount of time, the capacitor 54 still has an appropriate initial potential so that, as shown in FIG. 3, the injection start pulse does not have the long duration which it had at time zero during the first start signal. In other words, during a second starting attempt, the duration of the injection pulses, as a function of time, follows the dashed curve in FIG. 3. This behavior is ensured by the just described discharge circuit for the capacitor 54 when the circuit of FIG. 2 does not receive an enabling signal.

During a starting process, the conductor 24 receives a positive potential through the diode 75 and transmits it via a resistor 78 and a diode 79 to the contact point 9 in the circuit (see also FIG. 1) from which may thus be taken a voltage for suppressing the normal injection pulses of the fuel injection system of the vehicle.

For example, if the engine is actually "flooded" during starting attempts, the wide opening of the throttle, i.e., application of full throttle, may be employed to dry out the combustion chambers until ignition may resume. However, since it is obviously undesirable to supply fuel in maximum amounts during such starting attempts at full throttle, the point 15 in the circuit 2 is supplied with a potential derived, for example, from a switch near the throttle valve (not shown), which flows through resistors 81 and 82 directly to the bases of transistors 17 and 35 in the multivibrators 1 and 2, respectively, and thus prevents them from changing their state to the unstable condition at the occurrence of trigger pulses at the contact 46.

Only when the gas pedal is released does the control circuit of FIG. 2 return to normal operation, but, as may easily be recognized, with appropriately shortened injection pulse durations, since the charging process of the capacitor 54 in the Miller integrator was never interrupted.

Finally, the invention provides a circuit which prevents an influence on the duration of the injection pulses when the supply voltage has considerably decreased. This circuit consists of the series connection of a resistor 83 and a Zener diode 84 connected between the positive supply bus 70 and the negative supply bus 80. The junction of these two elements is connected to the junction of resistors 27, 26 and 41 in the charging circuit for the capacitors 32 and 37. During the charging phase of the capacitors 32 and 37, a voltage dependent current flows through the resistor 85. The circuit is so designed that, when the supply voltage drops, the charging process of capacitors 32 and 37 is speeded up. In principle, the circuit acts so that, when the supply voltage is high, the Zener diode 84 passes a relatively large current which results in an appropriately large voltage drop across the resistor 27 so that the junction of resistors 26 and 21 simulates a low voltage. When the supply voltage drops, this current is appropriately decreased.

In order to provide a possibility to influence the switching characteristics of the multivibrators 1 and 2 at very low and very high temperatures, the circuit of the invention provides additional elements. To influence the circuit at low temperatures, there is provided a series connection of resistors 87 and 88 connected between the two supply buses and the junction of these resistors is connected via an adjustable resistor 89 and parallel resistors 90 and 91 to the emitters of the discharge transistors 67 and 68, respectively. When the emitter potentials of these transistors are high, a current flows to the voltage divider composed of resistors 87 and 88 so that the discharge current is made smaller and the duration of the injection pulses increases. Accordingly, this circuit permits changing the injection pulse duration so as to correspond to the diagram shown in FIG. 4. In order to influence the switching characteristics at very high temperatures, there is provided a further voltage divider consisting of resistors 93 and 94, the resistor 94 being adjustable. The junction of these two resistors is connected through a diode 95 to the junction of resistors 27, 26 and 41. Since the voltage present at the input contact 28 is temperature dependent, if can fall to very low values for very high temperatures, so that injection pulses of sufficient duration cannot be produced. The just-described voltage divider circuit, including resistors 94 and 93, delivers a temperature independent potential which guarantees a minimum injection pulse duration even for very high temperatures.

A resistor 96 which joins the junction of resistors 94 and 93 to the circuit including the Zener diode 84 mades the high temperature adjustment independent of the supply voltage.

It should be noted that the curves shown in FIG. 3 are given for a single exemplary ambient temperature of −28° C.; for other ambient temperatures, the initial points of the curves on the ordinate, i.e., the fuel quantities injected at the onset of the starting process, are changed. This change is represented schematically in FIG. 4. The voltage divider circuit including resistors 87, 88, 90 and 91, which acts on the emitters of the discharge transistors 67 and 68 at very low temperatures, permits to adapt the slope of the curve of FIG. 4 to a particular motor vehicle and, thus, changes the initial points of the curves in the representation of FIG. 3.

The discharge of capacitors 32 and 37 in the multivibrators 1 and 2 takes place at constant current inasmuch as it occurs through transistors 67 and 68, repectively, thereby preventing irregularities due to different durations of discharge.

The foregoing in a description of a preferred embodiment of the invention and numerous variants and other embodiments are possible within the spirit and scope thereof, the latter being defined by the appended claims.

What is claimed is:

1. An apparatus for controlling fuel injection during cold starts of an internal combustion engine, said engine including a fuel injection system and means for producing a signal related to crankshaft rotation and a signal related to engine temperature, comprising:

a first monostable multivibrator whose output engages said fuel injection system, for providing special fuel injection control pulses during cold starts;

a first capacitor, connected to the input of said first multivibrator for controlling the period during which said first multivibrator resides in its unstable state;

a second monostable multivibrator triggered by said first monostable multivibrator for providing two separate fuel injection pulses for each crankshaft revolution;

a second capacitor for determining the unstable period of the second multivibrator, the charging of the first and second capacitors taking place by means of a temperature-dependent voltage;

a discharge control circuit for each capacitor for controlling the discharge of the capacitors to thereby control the switching of the multivibrators; and a master control circuit, for receiving said signals related to crankshaft rotation and for controlling said discharge control circuit.

2. An apparatus as defined by claim 1, wherein said master control circuit receives a temperature-dependent signal which is additionally made dependent on the duration of the cranking process, preferably on the number of crankshaft revolutions.

3. An apparatus as defined by claim 2, further comprising a triggering circuit which is provided with said signal related to crankshaft rotation, preferably an ignition signal, for triggering the switch-over of said first monostable multivibrator to its unstable state and also for integration within said master control circuit, the integrated potential of said signal defining a temperature-dependent control signal for said discharge control circuit.

4. An apparatus as defined by claim 3, further comprising a series subcircuit consisting of a resistor, a diode, a capacitor and a further resistor, said series subcircuit being connected between a signal input of said master control circuit and the ground conductor of said master control circuit and wherein said master control circuit further includes an integrating capacitor; whereby, when a trigger signal is supplied to said diode, said diode is thereby reversely biased and blocks so that said integrating capacitor sums up the triggering pulses provided to said master control circuit.

5. An apparatus as defined by claim 4, further comprising first and second transistors connected in Darlington configuration, said integrating capacitor being connected between the base and emitter of one of said Darlington transistors, the second one of said Darlington transistors providing the conductive path for a temperature-dependent signal whose magnitude also changes in dependence on the charge on said integrating capacitor.

6. An apparatus as defined by claim 5, wherein said integrating capacitor is connected to said discharge control circuit which provides a positive potential to a second diode in said master control circuit; whereby said discharge control circuit discharges said integrating capacitor at a predetermined time constant only during pauses in the cranking of the engine.

7. An apparatus according to claim 6, further comprising a triggering circuit including an RC member for differentiating said signal related to crankshaft rotation which signal is then used to trigger said first monostable multivibrator, said first monostable multivibrator including two transistors, the base of one of said two transistors being connected through a diode and a capacitor to said triggering circuit to receive said differentiated trigger pulse.

8. Apparatus as defined by claim 7, wherein the collector of said one transistor in said first monostable multivibrator is connected through a resistor to an output contact from which fuel injection pulses may be taken and is also connected through a diode to said second monostable multivibrator; whereby, when said first monostable multivibrator returns to its stable state a triggering pulse is fed to said second monostable multivibrator.

9. An apparatus as defined by claim 8, wherein said second monostable multivibrator includes a single transistor and a capacitor connected to the base of said single transistor; whereby the discharge of said capacitor determines the duration of the unstable state of said second multivibrator.

10. An apparatus according to claim 9, wherein said capacitors defining the unstable states of said first and second multivibrators can be discharged only via said discharge control circuit and wherein said discharge control circuit includes transistors forming a constant current source, the base of said transistors being connected with the output of said master control circuit.

11. An apparatus as defined by claim 10, wherein the emitters of said transistors in said discharge control circuit are connected through resistors to the positive supply of said circuit and wherein the collectors of said transistors are connected to said capacitors which determine the unstable state of said multivibrators.

12. An apparatus as defined by claim 11, wherein the transistors which define the duration of the unstable state of said first monostable multivibrator are connected by their collectors via resistors with a conductor which carries a positive potential during the cranking of the engine.

13. An apparatus as defined by claim 12, wherein said conductor carrying a positive potential during engine cranking is connected via a resistor and a diode to an output contact which provides a voltage for suppressing normal fuel injection pulses during engine cranking.

14. An apparatus as defined by claim 13, wherein the transistors in said first and second multivibrators which provide the start-up fuel injection pulses are provided at their bases with a potential during full throttle engine operation and while the engine is being cranked for preventing the switch-over of said first and second monostable multivibrators to the unstable state.

15. An apparatus as defined by claim 14, further comprising switch means associated with the throttle valve of the engine for grounding the base of said transistors in said first and second multivibrators.

16. An apparatus as defined by claim 1, further comprising a series subcircuit of a Zener diode and a resistor connected between the positive and the negative supplies of said apparatus, a point in said series subcircuit being connected via a further resistor to the junction of resistors lying in the charging circuit for said capacitors which are part of said monostable first and second multivibrators.

17. An apparatus as defined by claim 16, further comprising voltage divider means connected between said positive and negative voltage supplies of the apparatus, points of said voltage divider being connected to the emitters of said transistors in said discharge circuit.

18. An apparatus as defined by claim 17, further comprising a series connection of two resistors connected between the positive and negative supply lines of said apparatus, one of said resistors being adjustable, points of said series circuit being connected to said discharge control circuit for providing a temperature-independent charging voltage for said capacitors in said first and second multivibrators.

19. An apparatus as defined by claim 18, wherein said series circuit of resistors is connected to said series circuit containing a Zener diode.

20. A method for controlling fuel injection from fuel injection valves during cold engine starts; comprising the steps of:

disabling the supply of normal fuel injection control pulses to the fuel injection valves;

generating an engine temperature dependent voltage, such that the voltage decreases for increasing engine temperature;

generating trigger pulses synchronized with crankshaft rotation;

connecting a timing device to the fuel injection valves;

applying the trigger pulses to the timing device during which time the injection valves are controlled by the timing device;

generating a control voltage based upon the temperature voltage and the trigger pulses for controlling the duration of the timing device control of the injection valves; and varying the magnitude of the control voltage as a function of the temperature voltage and the number of trigger pulses elapsed during cranking.

21. The method as defined in claim 20, wherein a monostable multivibrator is connected to the fuel injection valves and serves as the timing device.

22. An apparatus for controlling fuel injection during cold starts of an internal combustion engine, said engine including a fuel injection system and means for producing a signal related to crankshaft rotation and a signal related to engine temperature, comprising:

a first timing device whose output engages said fuel injection system, for providing special fuel injection control pulses during cold starts;

a first capacitor, connected to the input of said first timing device for controlling the timing constant of said first timing device;

a second timing device actuated by said first timing device for providing two separate fuel injection pulses for each crankshaft revolution;

a second capacitor for determining the timing constant of the second timing device, the charging of the first and second capacitors taking place by means of a temperature-dependent voltage;

a discharge control circuit for each capacitor for controlling the discharge of the capacitors to thereby control the switching of the timing devices; and a master control circuit, for receiving said signals related to crankshaft rotation and for controlling said discharge control circuit.

* * * * *